US005501094A

United States Patent [19]

Mizuta et al.

[11] Patent Number: 5,501,094

[45] Date of Patent: Mar. 26, 1996

[54] METHOD FOR BENDING A METAL THIN PLATE

[75] Inventors: Akira Mizuta; Toshikazu Yamamuro, both of Kanagawa, Japan

[73] Assignee: Fuji Photo Film Co., Ltd., Kanagawa, Japan

[21] Appl. No.: 174,026

[22] Filed: Dec. 28, 1993

[30] Foreign Application Priority Data

Dec. 28, 1992 [JP] Japan ..... 4-358656
Apr. 13, 1993 [JP] Japan ..... 5-108736

[51] Int. Cl.[6] ..... B21D 5/01

[52] U.S. Cl. ..... 72/382; 72/389.2

[58] Field of Search ..... 72/389, 414, 382, 72/381

[56] References Cited

U.S. PATENT DOCUMENTS

| | | | |
|---|---|---|---|
| 3,705,512 | 12/1972 | Koschatzky | 72/389 |
| 4,660,403 | 4/1987 | Slasinski | 72/389 |
| 5,099,675 | 3/1992 | Heath | 72/389 |

FOREIGN PATENT DOCUMENTS

| | | | |
|---|---|---|---|
| 2805206 | 8/1979 | Germany | 72/389 |
| 3150426 | 7/1983 | Germany | 72/389 |
| 0117831 | 9/1981 | Japan | 72/389 |
| 0097313 | 4/1988 | Japan | 72/389 |
| 0518256 | 6/1976 | U.S.S.R. | 72/389 |

OTHER PUBLICATIONS

IBM, "Sheet Forming Die", Jul. 1966, p. 186.

*Primary Examiner*—David Jones
*Attorney, Agent, or Firm*—Sughrue, Mion, Zinn, Macpeak & Seas

[57] ABSTRACT

In the configuration wherein a metal thin plate is pressed by dies 2 to a punch 1 having unload channels 1*b* and 1*c* which elongates from one end of the punch 1 to the position corresponding to a tab-bent portion 60a of a workpiece 60, the edge portions of the punch 1 are chamfered as curved faces R or formed into an obtuse angle of 90° or more. After the metal thin plate is bent along the punch, the angle of the edge portions is formed by pressing the metal thin plate toward the punch, and the workpiece 60 is unloaded in the direction along which the dimensions of the unload channels 1*b* and 1*c* formed on the punch 1 can be shortened.

11 Claims, 9 Drawing Sheets

METHOD FOR BENDING A METAL THIN PLATE

BACKGROUND OF THE INVENTION

1. Field of the Invention

The invention relates to a method and an apparatus for bending a metal thin plate, and particularly to a method and an apparatus for conducting a U-shape bending process on a workpiece such as a metal shutter for a floppy disk.

A process in which a metal thin plate that has punched into a given shape is bent into a predetermined shape is employed in a wide variety of fields. An example of products obtained by such a bending process is a metal shutter for closing an opening of a cartridge of a floppy disk, a magnetooptical disk, or the like. Such a metal shutter is formed by bending a flat metal thin plate into a U-shape with a high accuracy. In this process, conventionally, dies and an apparatus having the configuration shown in FIGS. 1A to 3 are used. FIGS. 1A to 3 are schematic views showing the main portion of a bending apparatus having a conventional punch.

As shown in FIG. 2, a metal thin plate 60 is placed between a bending punch 101 and an ejection pad 103 urged by a spring 104, and the metal thin plate 60 is then pushed into a space formed between a pair of bending dies 122 having a die channel-like shape, thereby bending the metal thin plate into a U-shape.

In this process, the operation of pushing the metal thin plate 60 into the bending dies 122 is conducted by driving a shank 150 so as to lower a base 131, or so-called bottom push bending dies are used.

In this method, the bending dies 122 are of the fixed type or they are fixed to the base 131. As shown in FIG. 3, generally, the channel width W of the bending dies 122 is set to be a sum of the thickness w of the bending punch 101 and the double of the thickness t (t×2) of the metal thin plate 60.

In the process of the above-mentioned metal thin plate shutter, for example, in order to accurately conduct the bending while suppressing the spring back and the spring go to a level as low as possible, it is required to press the metal thin plate by a specific pressure of about 2 to 4 $t/cm^2$ into the bending dies 122 under an adequate pressure of the ejection pad 103.

As a result of the pressing under this specific pressure, there arises a problem in that a so-called biting state where the metal thin plate 60 which has been subjected to the bending process closely sticks to the bending punch 101 having edges of an acute angle easily occurs to make the unloading difficult to do and the workpiese is deformed when it is unloaded, resulting in a defective product. This state will be described in detail with reference to FIGS. 1A and 1B.

FIG. 1A is a perspective view showing a bending punch of a prior art apparatus and the state obtained immediately after a metal shutter, which is a workpiece, is formed by bending. FIG. 1B is a section view taken at B—B and showing the upper portion of the bending punch.

As shown in FIG. 1A, the metal shutter 60 has a cutout portion 61 in the vicinity of its one end, and tab-bent portions 60*a* and 60*b* in the vicinity of the other end. The cutout portion 61 comprises a tab-bent portion 61*a*.

The metal shutter 60 which has been formed by the bending process is unloaded from the bending punch 101 while being slid thereon. In order to pass the tab-bent portions over the bending punch, the bending punch 101 is required to be provided with unload channels which extend to one end of the punch and open on the end.

From the view point of maintaining the strength of the bending punch 101 to a higher level, it is preferable to form the unload channels as short as possible. Accordingly, formerly, the unload channels are elongated in direction +X (toward the right of FIG. 1A) so as to open on the right end, and the metal shutter 60 is pushed at its left end to be unloaded in direction +X (toward the right of FIG. 1A). However, the metal shutter 60 strongly bites the bending punch 101 as described above, so that a large pushing force must be applied to the metal shutter. On the other hand, the metal shutter 60 has a reduced strength because the cutout portion 61 of a large size is formed in the left portion. Consequently, such a metal shutter 60 is often deformed during the unloading process, resulting in a defective product.

In order to eliminate the application of the pushing force on the portion in the side of the cutout portion 61 of the metal shutter, recently, an improved configuration is adopted as described below. In the improved configuration, the unload channels 1*b* and 1*c* are formed so as to open on the left end of the bending punch 101 as shown in FIG. 1A, and the metal shutter 60 is pushed at its right end in direction −X by an unload pusher 70.

This configuration can somewhat improve the proportion of defective products owing to deformation of the metal shutter 60 during the unloading process. However, the upper-face channel 1*b* and the side-face channel 1*c* which are unload channels of the bending punch 101 must be formed so as to extend over a long distance as illustrated, whereby the strength of the bending punch 101 is lowered. This produces another problem in that the bending punch is easily damaged and its service life is shortened.

In addition to the above, the process of producing the punch is complicated so that the production cost of the punch is increased.

Furthermore, in the prior art method, the distance between the dies and the punch is varied depending on the scatter of the thickness of a metal plate, and therefore it is actually impossible to stably apply a predetermined specific pressure to a metal plate. Consequently, the prior art method has a further problem in that also the size of the U-shape bent portion is scattered.

In order to solve these problems, Japanese Patent Publication (Kokoku) No. Hei. 4-4047 discloses an apparatus in which edges of a die portion are constructed as inclined faces. Japanese Patent Publication (Kokai) No. Hei. 3-264116 discloses a method of, at the bottom dead point of the pressing stroke, giving a compression plastic strain of 1 to 3% to the both end portions of a web of a metal plate. In the method, the compression plastic strain is produced in the inner region within one fourth of the both side ends except the bending angle rounded portion of the bottom of a die channel.

In all of the disclosed techniques, as far as dies of the fixed type are used in the same manner as the prior art, it is impossible to completely solve the problems owing to the scatter of the thickness of a metal plate. Moreover, the disclosed techniques have a drawback in that, when parts of the apparatus wear as a result of a long term use, the positional alignment of the parts is deviated so that the bending cannot correctly be conducted, resulting in that the size of the bent portion is scattered.

In a metal shutter for a magnetic disk cartridge, particularly, the bending accuracy depends on the accuracy of the edge portions of the front and back plate portions and the top plate portion. Even when the edge portions are formed with a slightly reduced accuracy, the distance between the tips of the front and back plate portions is largely deviated from the specified value. Therefore, the bending process is required to be conducted with a very high accuracy.

SUMMARY OF THE INVENTION

The invention has been conducted in order to solve the above-discussed problems of the prior art. It is an object of the invention to provide a method and an apparatus for bending a metal thin plate in which stress generated in a punch during a pressing process is locally dispersed so that the life period of the punch is improved and the occurrence rate of the phenomenon of the biting of a workpiece is reduced to improve the proportion of defective products in the unloading process, and the period of the process of forming the punch is shortened to reduce the production cost of the punch.

Furthermore, the invention has been conducted in view of the problems of the prior art. It is another object of the invention to a method and an apparatus for bending a metal thin plate in which, even when the thickness of a metal thin plate is scattered, a predetermined specific pressure can stably be applied to the metal plate by a very simple method and configuration.

The object of the invention can be accomplished by a method of bending a metal thin plate in which, under a state where the metal thin plate is sandwiched between a punch having an unload channel which elongates from one end of the punch to a position corresponding to a tab-bent portion of a workpiece, and pressing means, the metal thin plate is bent toward the punch by dies which are respectively located at the both sides of the pressing means, thereby forming the metal thin plate into a shape having a U-like section, wherein a punch in which edge portions are chamfered as curved faces or formed into an obtuse angle of 90° or more (chamfered or tapered) is used as the punch, the angle of the edge portions is formed by pressing the metal thin plate toward the punch after the metal thin plate is bent along the punch, and the workpiece is unloaded in the direction along which the dimension of the unload channel formed on the punch is shortened.

Furthermore, the object of the invention can be accomplished by an apparatus for bending a metal thin plate in which the metal thin plate is sandwiched between a punch having an unload channel which elongates from one end of the punch to a position corresponding to a tab-bent portion of a workpiece, and pressing means which opposes the punch, and the metal thin plate is bent toward the punch by dies which are respectively located at the both sides of the pressing means, thereby forming the metal thin plate into a shape having a substantially U-like section, wherein edge portions of the punch are configured as chamfers of a curved face or formed into an obtuse angle of 90° or more (chamfered or tapered), the dies are movable in the direction of bending the metal thin plate and also in the direction of pressing the metal thin plate to the punch, and the workpiece is unloaded in the direction along which the dimension of the unload channel formed on the punch is shortened.

The second object of the invention can be accomplished by a method of bending a metal thin plate in which, under a state where the metal thin plate is sandwiched between a punch and pressing means, the metal thin plate is bent toward the punch by dies which are respectively located at both sides of the pressing means, wherein a die holder base for holding the dies and having a double base structure in which two bases are stacked in the movement direction is set to be a state where the bases are separated from each other by an initial distance, the bases being provided with urging forces which repel each other, a pair of the dies which are disposed on the holder base in the side of the punch are urged in the direction along which the distance between the dies is shortened, and are kept to a state where the dies are engaged in the middle of the urge against the urging force, after the metal thin plate is supplied under this state between the punch and the pressing means, the die holder base is moved toward the punch, thereby bending the metal thin plate substantially along the punch, a relative movement in the direction along which the initial distance between the bases is shortened is then produced by further pressing the die holder base toward the punch, and the engagement is canceled by the relative movement to allow the dies to be pressed toward the punch, thereby forming an angle of bent edge portions of the metal thin plate.

Furthermore, the second object of the invention can be accomplished also by an apparatus for bending a metal thin plate in which the metal thin plate is sandwiched between a punch and pressing means which opposes the punch, and the metal thin plate is bent toward the punch by dies which are respectively located at the both sides of the pressing means, thereby forming the metal thin plate into a shape having a substantially U-like section, wherein a die holder base for holding the dies has a double base structure in which first and second bases are stacked in the movement direction, an urging member is disposed between the bases to exert an urging force by which the bases are caused to repel each other, and the distance between the bases is changeable within a predetermined range, each of the dies is disposed on the first base, rotatably supported by a shaft, and urged by an urging member in the direction along which the distance between working faces of the dies is shortened, the urging members being disposed between the dies and the first base, the die being engaged by a stopper arm against an urging force of the urging member in the middle of the urge, the stopper arm being fixed to the second base, a punch holder for holding the punch is provided with a stopper which can butt a part of the first holder on which the dies are held, thereby limiting the movement of the first base, and the engagement between the dies and the stopper arms is canceled when the die holder is moved toward the punch and the stopper butts the first base, thereby further pressing the metal thin plate which is bent substantially along the punch, toward the punch.

BRIEF DESCRIPTION OF THE DRAWINGS

FIG. 7 is a section view taken at XII—XII of FIG. 6.

DETAILED DESCRIPTION OF THE INVENTION

Figure 4:
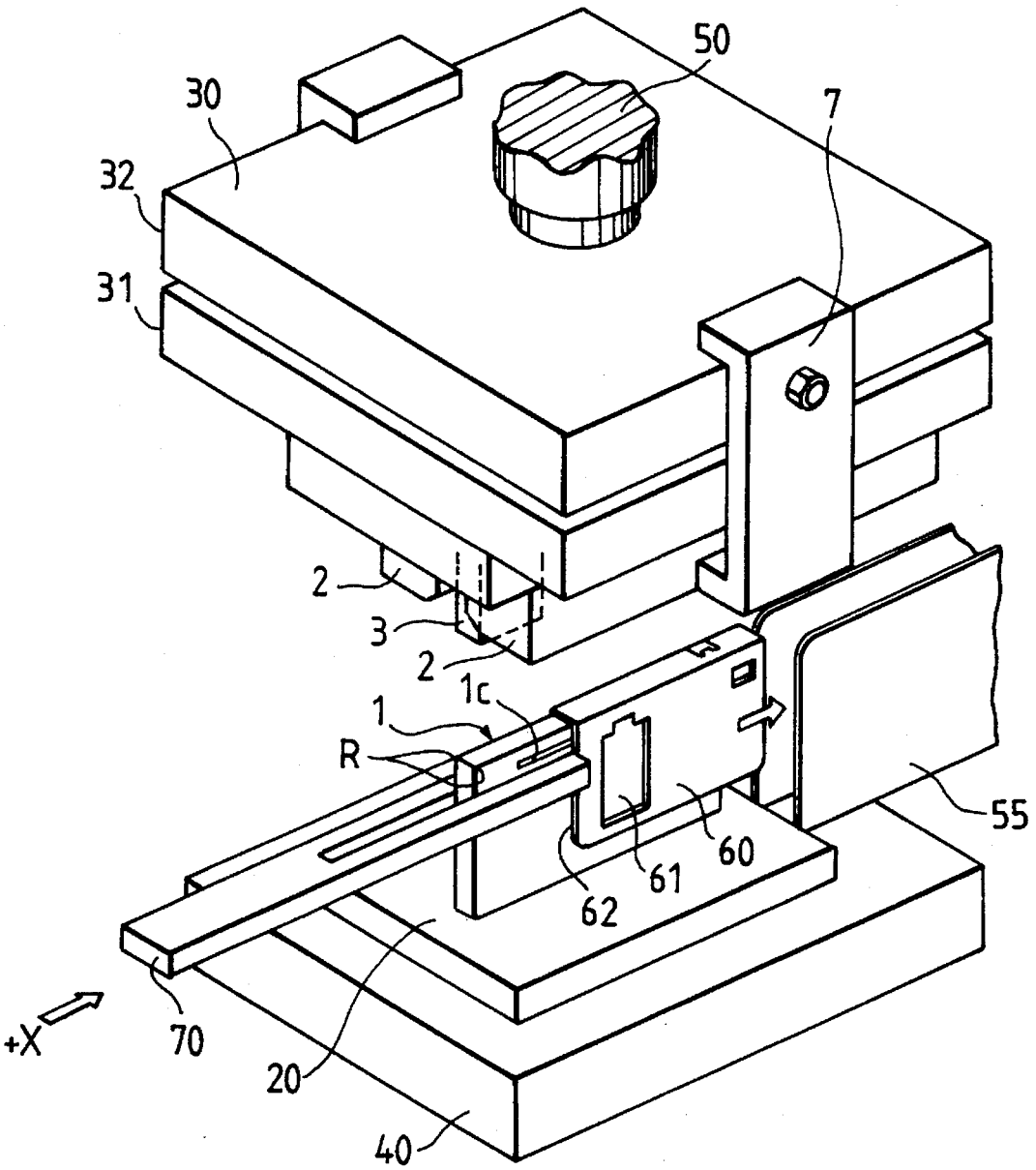
FIG. 4 is a perspective view showing the main portion of an apparatus for bending a metal thin plate according to a first embodiment of the invention.
Figure 5:
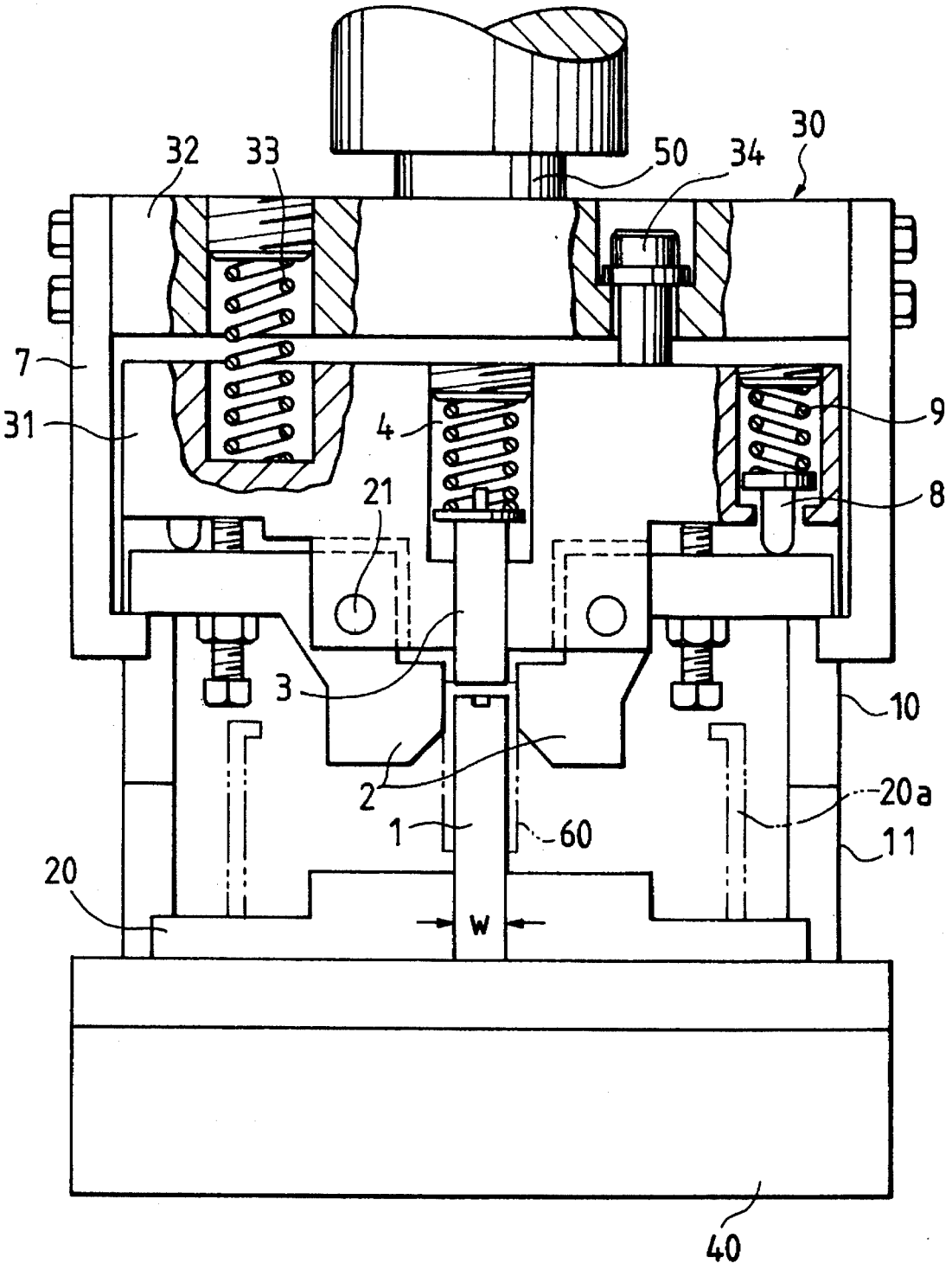
FIG. 5 is a front view of the apparatus for bending a metal thin plate according to the first embodiment of the invention.
Figure 6:
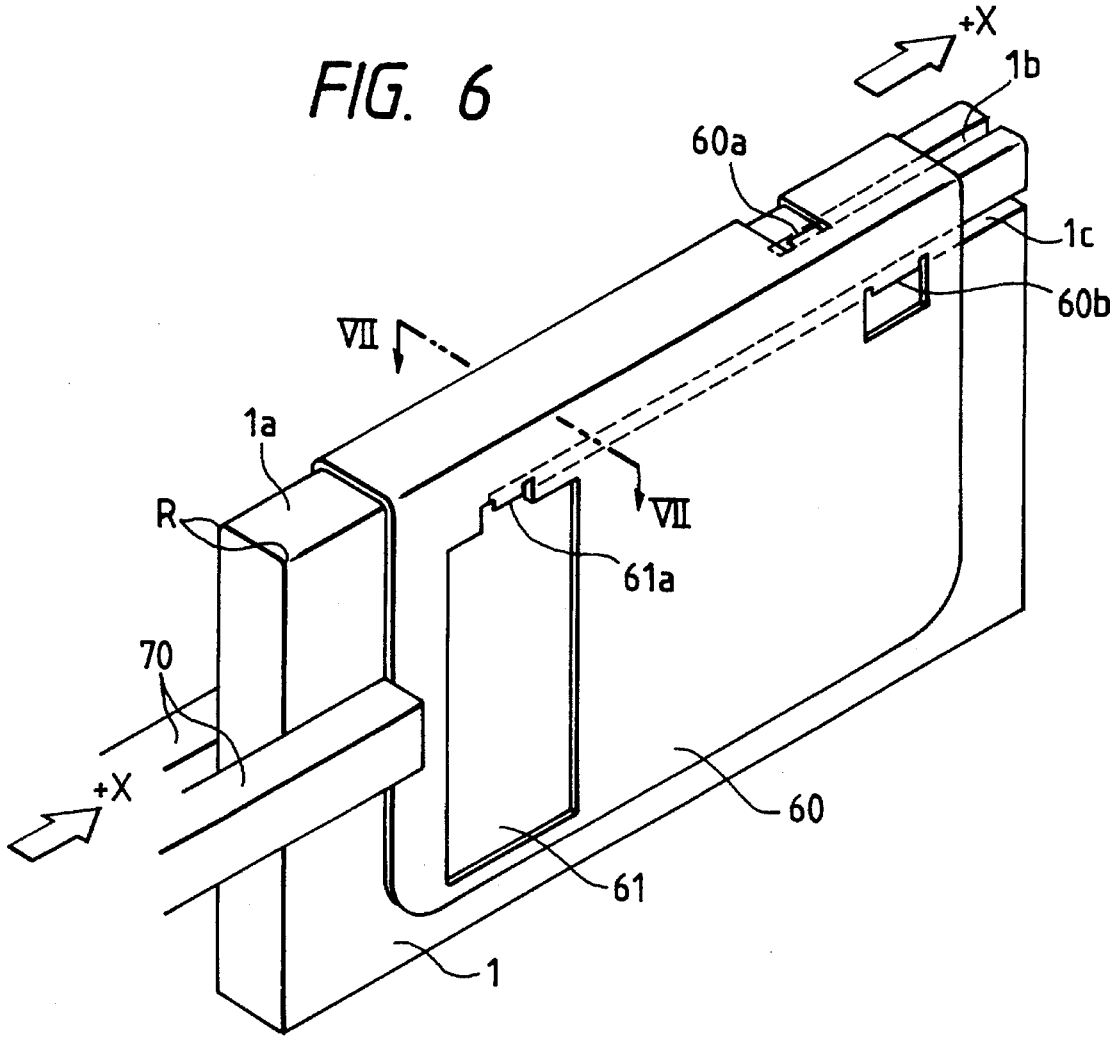
FIG. 6 is a perspective view showing in detail a punch used in the first embodiment of the invention, and a workpiece obtained by bending a metal thin plate.

Hereinafter, embodiments of the invention will be described with reference to the drawings. FIGS. 4 to 7 show an embodiment of the invention. FIGS. 4 and 5 show a bending apparatus for producing a metal shutter for a magnetic disk cartridge, FIG. 6 is a perspective view of a bending punch of the apparatus of the embodiment and a processed metal shutter, and FIG. 7 is a partial section view of the bending punch.

First, the configuration of the first embodiment of the apparatus for bending a metal thin plate will be described with reference to FIGS. 4 and 5.

The bending apparatus (pressing machine) of the embodiment is a so-called die set which generally comprises an upper base 30 located in the upper side, and a lower base 40 located in the lower side.

A bending punch 1 is held at the center of the lower base 40 by a punch holder 20. Positioning guides 20*a* for positioning a flat metal thin plate which is a blank for a metal shutter 60 (see FIG. 6) are disposed at the both sides of the bending punch 1. A plurality of lower stoppers 11 are disposed in the area outer than the positioning guides 20*a*. When the upper base 30 is lowered, the lower stoppers 11 respectively butt against upper stoppers 10 attached to a first base 31 so as to receive the working pressure of the upper base 30.

The bending punch 1 has a width w which is substantially equal to that of the metal shutter 60 shown in FIG. 6, and a length in the lateral direction which is greater than the length of the metal shutter 60.

In the specification, the term "metal thin plate" means a metal thin plate which has a thickness of about 0.1 to 0.5 mm and which is made of a material such as SUS304.

An unload pusher 70 which can reciprocate in directions X shown in FIG. 4 (the right and left directions in FIG. 4, and the directions perpendicular to the sheet in FIG. 5) is disposed above the lower base 40 and at a position which is slightly higher than the center of the bending punch 1. The pusher 70 has a fork-like shape in which a long notch elongates from the front end in the longitudinal direction. When the bending process is completed, the pusher 70 is driven by driving means which is not shown, to advance in the unload direction +X in such a manner that the bending punch 1 enters the opening of the notch and the front end of the pusher then butts an end face 62 of the metal shutter 60. The pusher 70 further advances to push out the metal shutter 60 in direction +X. The metal shutter 60 is unloaded from the bending punch 1 in this way, and then accommodated in an unload guide 55.

The upper base 30 comprises the first base 31 and a second base 32. The second base 32 is connected to a shank 50 which is coupled at its upper portion to a press driving force. A plurality of compression springs 33 are interposed between the first base 31 and the second base 32 and at adequate locations. During the period when the apparatus is not operated, the two bases are kept separated from each other by a predetermined distance, by the combination of the resilience of the compression springs 33 and hanging bolts 34 which are disposed at adequate locations. A pair of bending dies 2 each of which is rotatably supported by a shaft 21 are disposed inside the upper base 30 in such a manner that the dies oppose to each other. The paired bending dies 2 have a substantially L-like shape in a side view. One end of each of the bending dies 2 is pushed by a press pin 8 which is urged downward by a pressure spring 9. In order to counter the urging force, each bending die 2 is provided with a stopper arm 7 engaging with the face of the bending die which is opposite to that pressed by the press pin 8.

An ejection pad 3 formed as a rectangular parallelpiped is disposed between the paired bending dies 2. In the process of bending a metal thin plate, the ejection pad 3 cooperates with the bending punch 1 so that the workpiece is always urged at the optimum pressure by a pressure spring 4.

Next, the operation will be described. The process of the bending apparatus of the invention consists of two cycles, a bending cycle and an unloading cycle.

In the bending cycle, a metal thin plate is fed to a prefixed position by a feeding apparatus which is not shown, and the upper base 30 starts to be lowered by the driving force exerted through the shank 50. When the upper base 30 is lowered to a predetermined position, the metal thin plate is pressed by the combination of the bending punch 1 and the ejection pad 3. The upper base 30 is further lowered to cause the metal thin plate to be bent and pushed while maintaining this bent state, into a space formed between the bending dies 2 (the states shown in FIGS. 4 and 5).

After the upper stoppers 10 butts the lower stoppers 11, the upper base 30 is further lowered, and the engagement of the paired bending dies 2 and the stopper arms 7 is canceled so that each bending die 2 is allowed to be rotatable about the respective shaft 21 functioning as a fulcrum. Under this state, the pressing forces of the press pins 8 urged by the pressure springs 9 cause the bending dies 2 to be subjected to a lever force, whereby the edge portions of the bent side faces of the metal thin plate are strongly pressed.

In other words, the paired bending dies 2 are driven so as to shorten the distance between the paired bending dies 2. As a result, a required specific pressure is applied to the metal thin plate, and the metal thin plate is bent to be formed into the metal shutter 60, thereby completing the bending cycle.

After the bending cycle, the unloading cycle starts to unload the workpiece or the metal thin plate 60. When the upper base 30 is moved upward and the bent metal shutter 60 appears with sticking to the bending punch 1, the unload pusher 70 which remained to be retracted during the bending cycle is driven by the driving means which is not shown, to start the advancement in the unload direction +X. The unload pusher 70 advances in the unload direction +X in such a manner that the bending punch 1 enters the opening of the long notch which elongates in the longitudinal direction, and the front end of the unload pusher 70 butts the end face 62 of the metal shutter 60. Under this state, the unload pusher 70 further advances to push out the metal shutter 60. The metal shutter 60 which is removed from the bending punch 1 in this way is then received in the unload guide 55.

The bending apparatus of the invention operates in the manner described above. In the same way as a prior art apparatus, also in the apparatus of the invention, a metal thin plate is pressed against the bending punch during the bending process by a considerably high specific pressure. As described later, the method and the apparatus of the invention can prevent a so-called biting state where the metal thin plate 60 which has been subjected to the bending process closely sticks to the bending punch 1 to make the unload of the workpiece difficult to do, from occurring. As a result, the workpiece can easily be unloaded, and therefore the problem that a workpiece is deformed during the unloading process to become a defective product can be solved. In addition, according to the invention, it is possible to reduce the cost of the bending punch. This will be described in detail with reference to FIG. 6.

FIG. 6 is a perspective view showing a bending punch of the apparatus of the invention and a metal shutter (workpiece) which has just been subjected to the bending process, and FIG. 7 is a section view taken at XII—XII and showing the upper portion of the bending punch.

As shown in FIG. 6, the metal shutter 60 has a cutout portion 61 in the vicinity of its one end, and tab-bent portions 60*a* and 60*b* in the vicinity of the other end. The cutout portion 61 comprises a tab-bent portion 61*a*.

In order to unload the metal shutter 60 which has been subjected to the bending process from the, bending punch 1 while being slid thereon, the bending punch 1 is required to be provided with unload channels through which the tab-bent portions 60*a* and 60*b* respectively pass. Furthermore, the unload channels must open on one end of the punch.

In the view point of maintaining the strength of the bending punch 1 to a higher level, it is preferable to form the unload channels as short as possible. As described above, in the prior art, a workpiece strongly bites the punch so that a large force must be exerted in the unloading process. This often causes the workpiece having the cutout portion to be deformed and result in a defective product. Therefore, this configuration cannot be adopted.

In order to eliminate the application of the pushing force to the portion having a reduced strength, the configuration in which the long unload channels are formed and a workpiece is pushed in the direction opposite to that in the prior art was adopted as described above. As a result, damages owing to the reduced strength of the bending punch shortens the service life of the punch, and the process of forming the punch is complicated so that the production cost of the punch is increased.

Figure 1A:
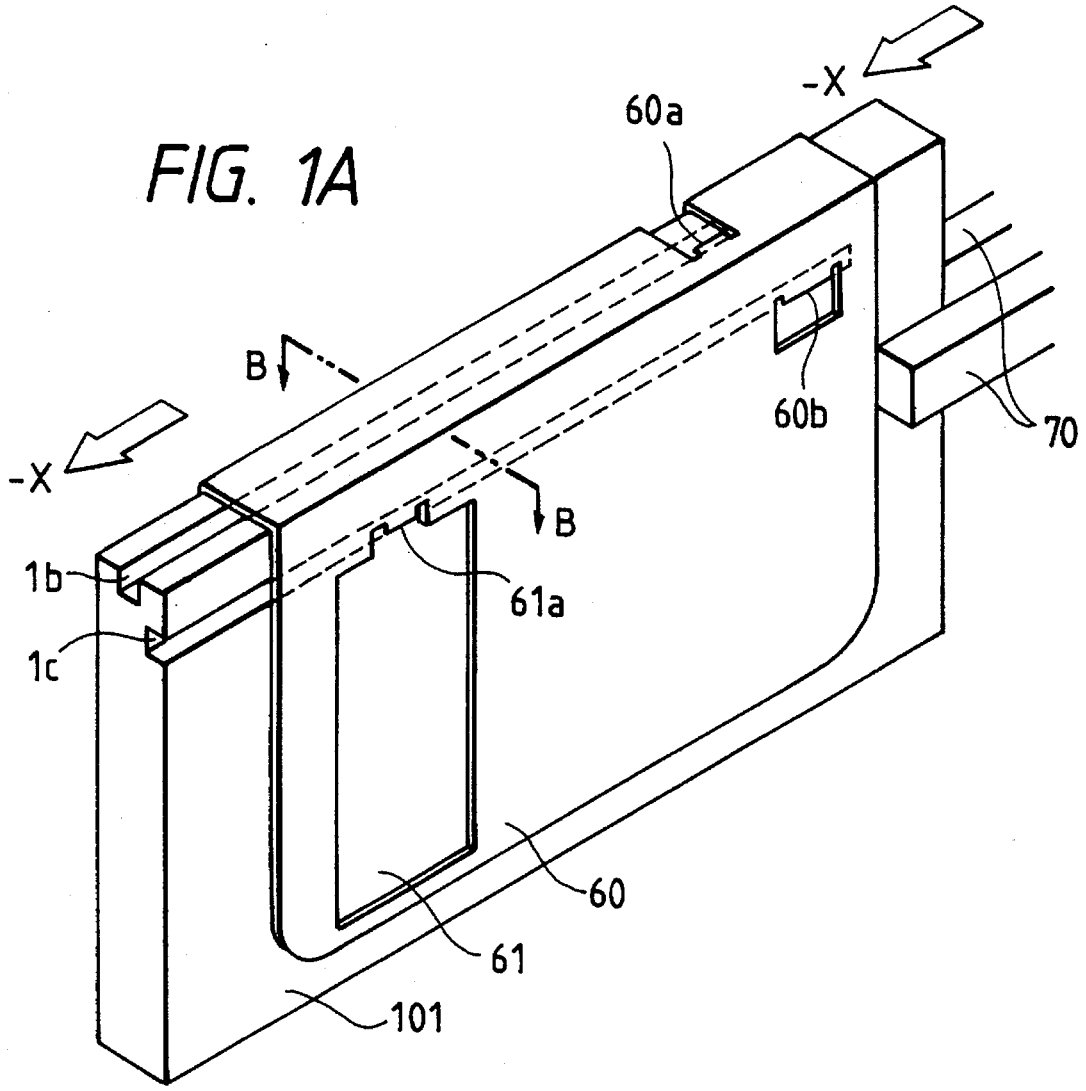
FIG. 1A is a perspective view showing in detail a punch of a prior art and a workpiece obtained by bending a metal thin plate.
Figure 1B:
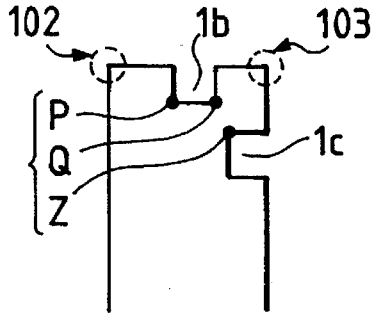
FIG. 1B is a section view taken at B—B of FIG. 1A.
Figure 2:
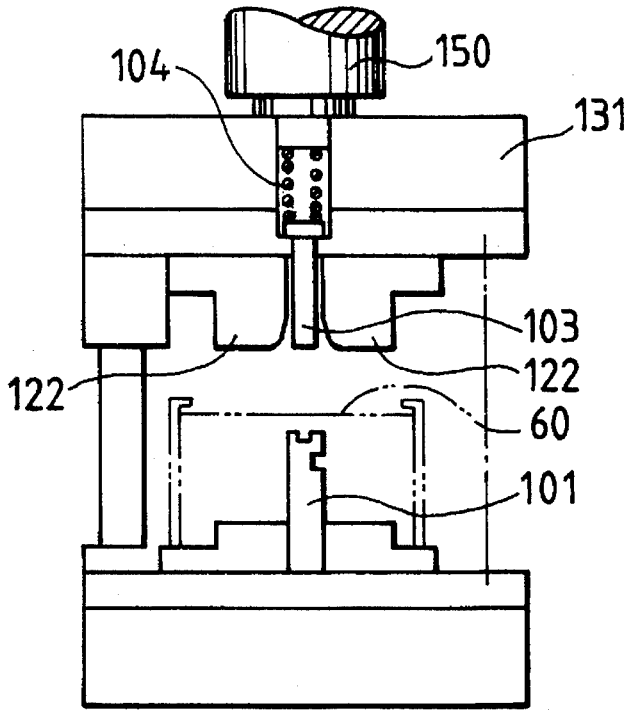
FIG. 2 is a diagram of a bending apparatus of the prior art.
Figure 3:
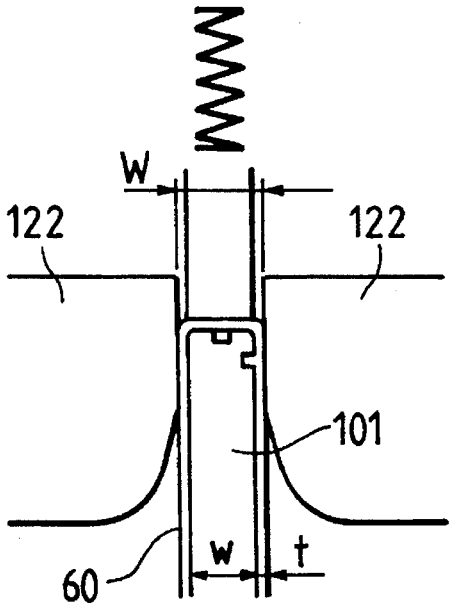
FIG. 3 is a diagram illustrating the operation of the dies portion of FIG. 2.

In order to improve the strength of a conventional punch having long unload channels, according to the invention, edge portions of the punch in the vicinity of the unload channels are provided with curvature so that the edge portions are configured as curved faces in place of edges of an acute angle in the prior art. In damaged punches in the prior art, for example, among breaking positions P, Q and Z shown in FIG. 1B, the positions Q and Z where breaking easily occurs are to be particularly inspected. Then, it will be noted that stress induced by an external force which is applied to an edge 103 of an acute angle concentrates on these positions Q and Z. In the invention, therefore, a configuration satisfying the following two points are realized: (a) an external force is prevented from concentrating on a limited position in an edge portion or an edge, and dispersed in a region as wide as possible; and (b) the breaking force in this case acts as a moment, and therefore the distance between the breaking position and the point to which the external force is applied is made shorter than that in the prior art.

Figure 7A:
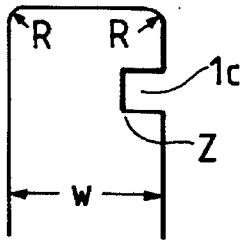
FIG. 7A shows a rounded chamfer.

As shown in FIG. 7A, the edge portions are configured as curved faces R having large curvature, in place of edges of an acute angle in the prior art. In this configuration, when an external force is applied to one of the edge portions, the external force is distributed to various positions of the corresponding curved face. Since the edge portion is configured as a chamfered face, moreover, also vector components of stress induced by the external force at these positions are distributed over a wide solid angle. Consequently, it is possible to prevent stress from concentrating on a limited position, for example, the position Z of FIG. 7A.

Since the edge portions have a curved face, the distance between the breaking position and the point to which the external force is applied can be made shorter than that obtained in the case where edge portions have an acute angle. Accordingly, also because of this point, it is possible to reduce the number of occurrences of breaking.

Figure 7B:
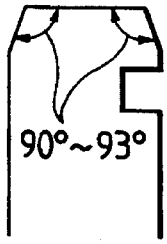
FIG. 7B shows a tapered chamfer.
Figure 7C:
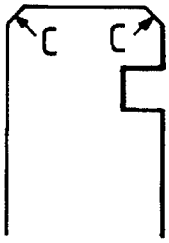
FIG. 7C shows a chamfer.

In the embodiment, the two edges of the upper face 1*a* of the bending punch 1 are configured as two curved faces R shown in FIG. 7 in accordance with the above-discussed points. The same effects can be attained also in the case where only one of the two edges is configured as a curved face. In place of the curved faces R, the edge portions may be beveled (or chamfered) by a flat face as shown in FIG. 7C, or configured as tapered chamfers so that the edge portions have an angle of 90° or more (90° to 93° ) as shown in FIG. 7B.

Preferably, the curvature of the curved faces R (in the case of a chamfered edge, the length of one of the sides of the right-angled triangle in which the other side is the chamfered portion) is set to be 0.05 to 0.10 mm when the metal thin plate is made of SUS304 and has a thickness t of 0.18 to 0.21 mm. When the curvature is set to be a value in this range, the metal shutter 60 can be prevented from biting the punch 1, and the bending accuracy of the edge portions is excellent, or the distance between the opposing tips can be within the range of the desired value ±0.3 mm.

As described above, the edges of the upper face la of the bending punch 1 are configured as curved faces in order to prevent the punch from being damaged and improve the life period of the punch. As a result of various embodiments, it has been found that this configuration exhibits a very excellent effect on the reduction of the occurrence rate of the sticking of a workpiece to the punch or the above-mentioned phenomenon of the biting of a workpiece. In other words, it has been found that the configuration has also an effect of reducing the proportion defective in the unloading process.

As a result, the invention can be executed effectively while conducting the unloading process of the metal shutter 60 in either of the above directions. In other words, it is possible to configure the apparatus so that, as shown in FIG. 6, the metal shutter 60 is unloaded without deformation by pushing its side portion having the cutout portion 61 in direction +X with the pusher 70.

As a result, as shown in FIG. 6, the dimensions of the unload channels, particularly the length of the upper-face channel 1*b* can be reduced in a very large degree as compared with those in the prior art, thereby enabling the life period of the punch to be further improved. Furthermore, the reduced dimensions of the unload channels an shorten the process of producing the punch. This allows the period required for producing the punch to be shortened, and in addition the cost of the punch to be reduced. In this way, many advantages can be realized simultaneously.

According to the method and the apparatus of the invention, therefore, the entire configuration including the pusher 70 and the unload guide 55 is designed and arranged so that a workpiece is ejected or unloaded in the direction along which the dimensions (particularly the lengths) of the unload channels such as the upper-face channel 1*b* and the side-face channel 1*c* can be shortened.

As apparent from the above description, the method of bending a metal thin plate and the apparatus for performing the same according to the invention can achieve all of the followings: (a) improvement of the life period of a punch owing to the reduction of the occurrence number of a punch damage; (b) reduction of the proportion defective in the unloading process owing to the reduction of the occurrence number of the biting; (c) shortening of the process of producing a punch; and (d) reduction of the cost of the punch. Accordingly, the invention produces excellent effects on the industry.

In the above, the first embodiment in which a shutter for a 3.5-inch magnetic disk cartridge and made of a stainless steel thin plate is produced has been described. The method and the apparatus of the invention can be applied to various processes of producing a bent metal thin plate with using a punch, such as a shutter for a cartridge of an optical disk, and an MD (microfloppy disk).

In the first embodiment, the bending punch is disposed on the lower base and the bending dies are attached to the upper base. According to the invention, the positional relationship may be inverted. Also this modification can attain the entirely same functions. The shape and the like of the pusher for unloading a workpiece and the punch are not restricted to those shown in the figures.

Figure 8:
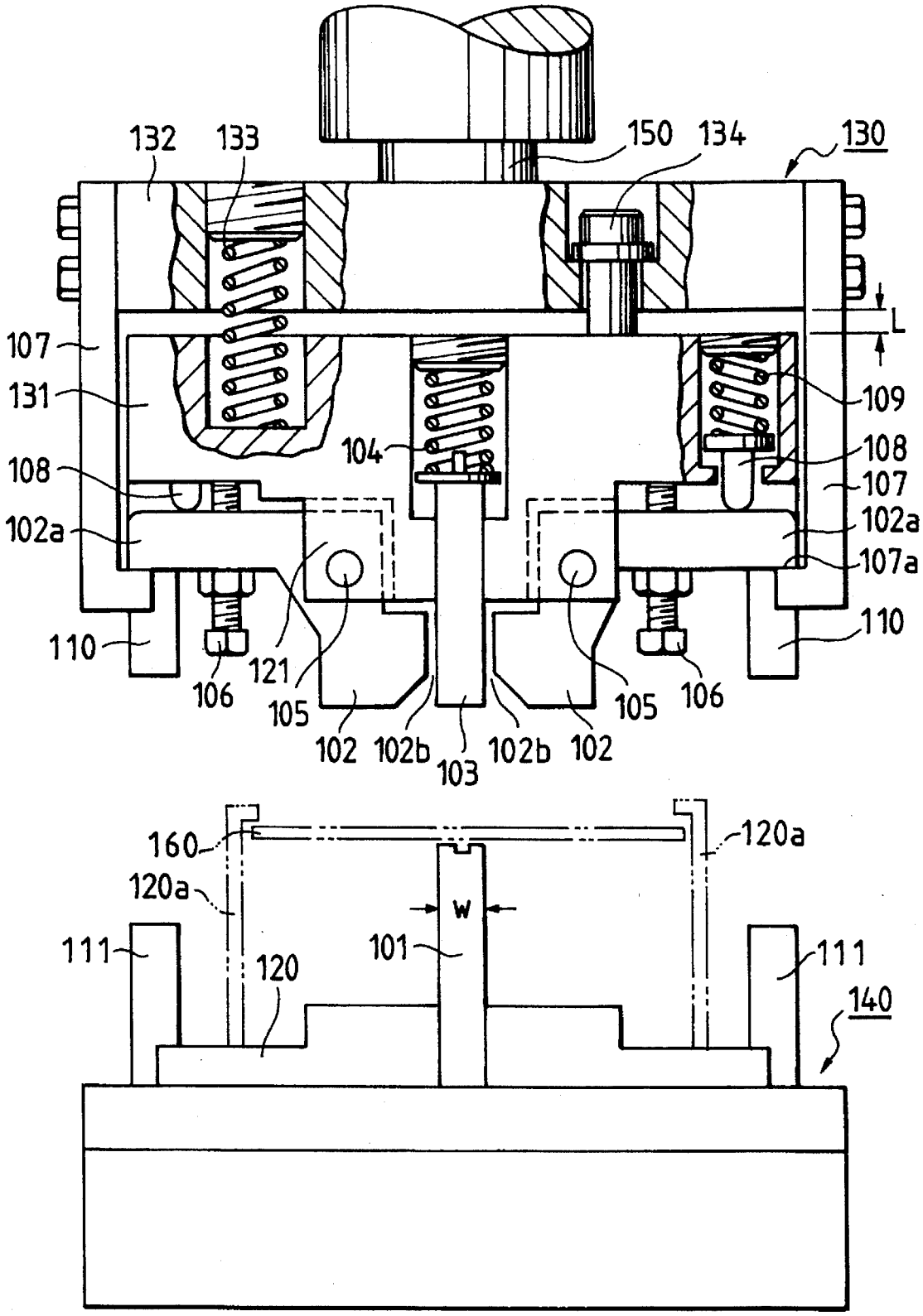
FIG. 8 is a partially fragmentary front view of an apparatus according to a second embodiment of the invention.
Figure 9:
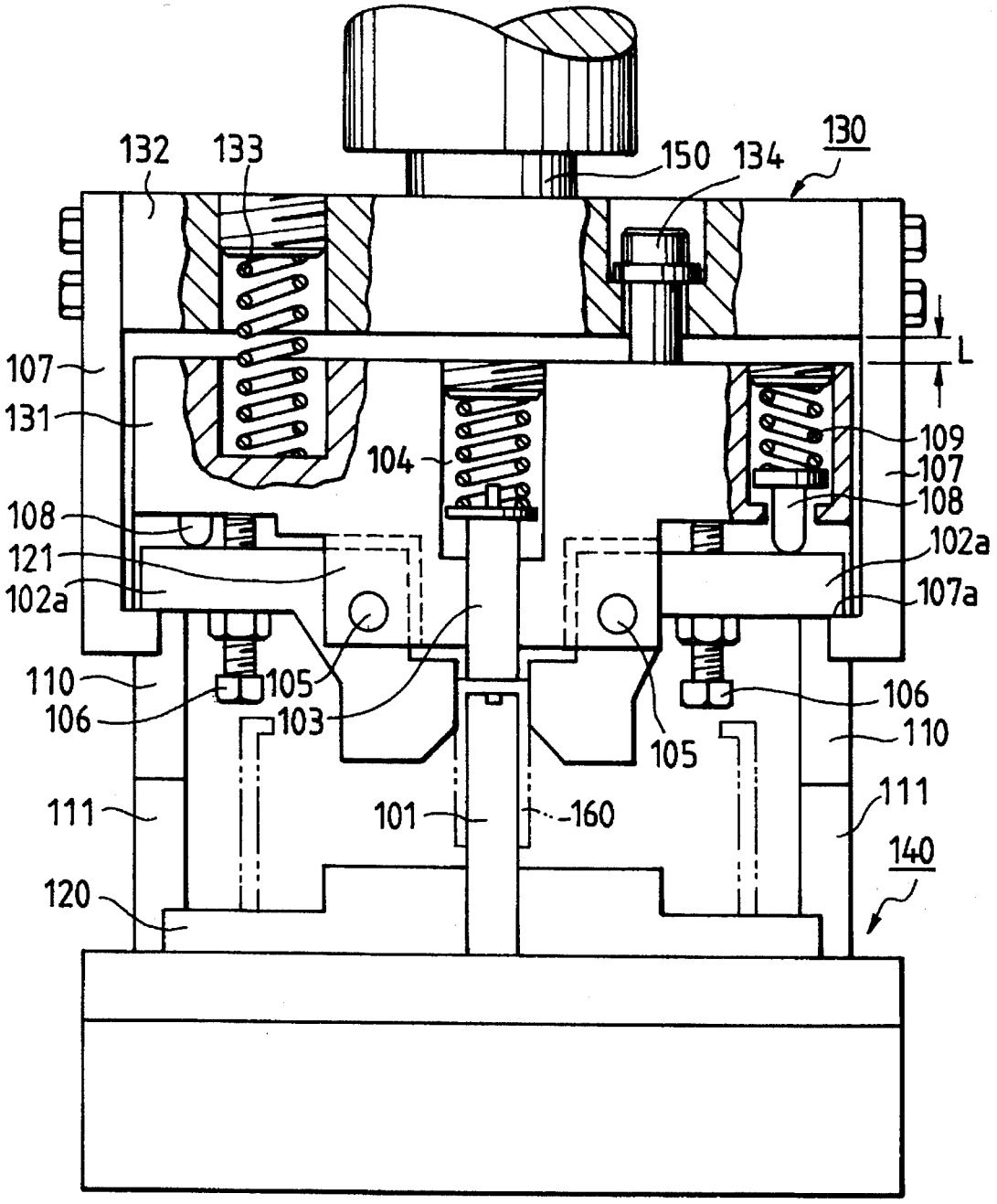
FIG. 9 is a partially fragmentary front view of the apparatus of FIG. 8 which is under operation.
Figure 10:
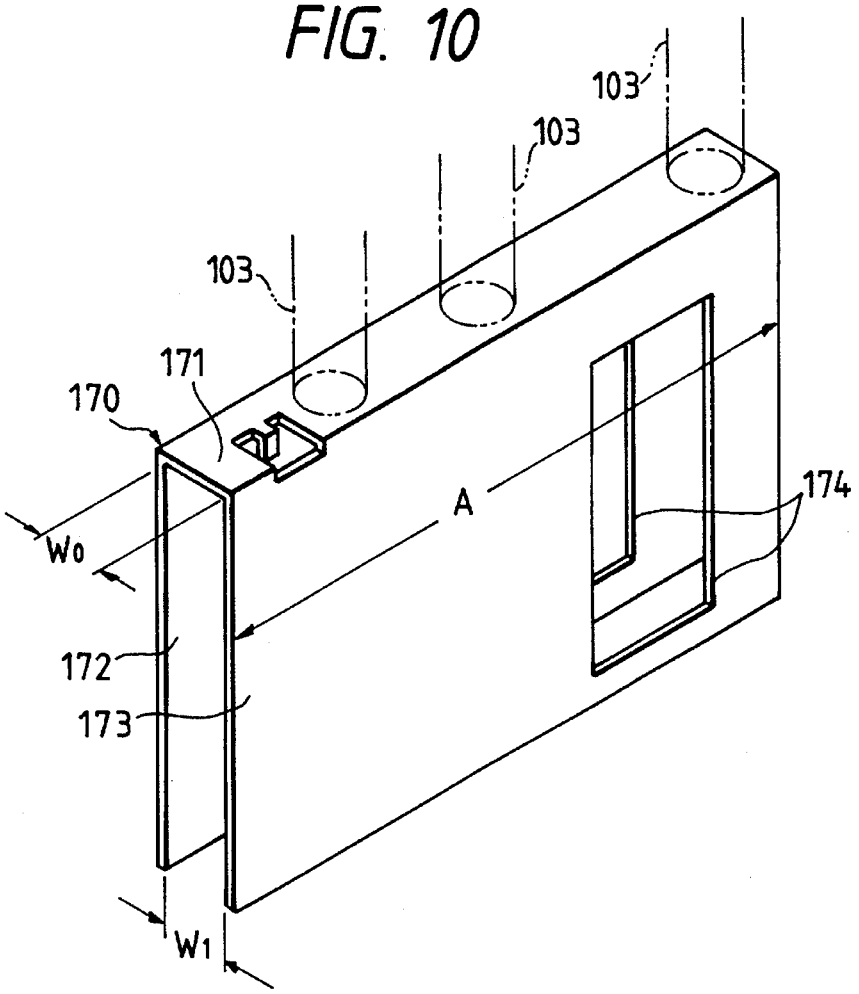
FIG. 10 is a perspective view of a product formed by the apparatus of the invention.
Figure 11:
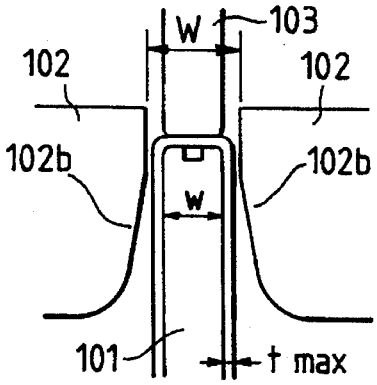
FIG. 11 is a diagram illustrating the operation of the main portion (dies portion) of FIG. 8.
Figure 12:
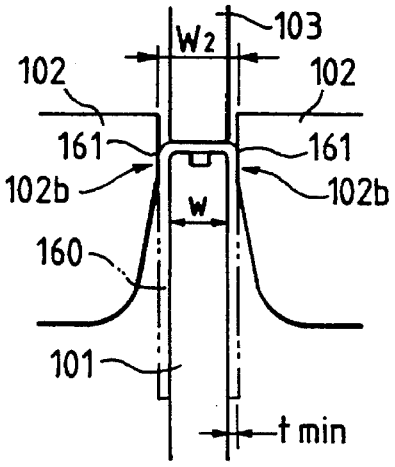
FIG. 12 is a diagram illustrating the operation of the main portion (dies portion) of FIG. 8.

Hereinafter, a second embodiment of the invention will be described with reference to the drawings. FIGS. 8 to 12 show the second embodiment of the invention. FIGS. 8 and 9 show a bending apparatus for producing a metal shutter for a magnetic disk cartridge, FIG. 10 is a perspective view of a metal shutter formed by the apparatus of the embodiment, and FIGS. 11 and 12 are diagrams showing the main portion on an enlarged scale and illustrating the operation of the apparatus of the embodiment.

The bending apparatus (pressing machine) of the embodiment is a so-called die set which generally comprises a die holder base 130 located in the upper side, and a punch holder base 140 located in the lower side. The die holder base 130 is vertically guided in a highly accurate manner by guide posts, etc. which are not shown.

The punch holder base 140 comprises a punch holder 120. A punch 101 is held at the center of the punch holder base 140 by the punch holder 120. Positioning guides 120*a* for positioning a flat metal thin plate 160 which is a blank for a metal shutter 170 (see FIG. 10) are disposed at the both sides of the punch 101. Lower stoppers 111 are disposed in the area outer than the positioning guides 120*a*. When the die holder base 130 is lowered, the lower stoppers 111 butt upper stoppers 110 attached to a first base 131 so as to receive the working pressure of the die holder base 130. The punch 101 has a width w which is substantially equal to the width $w_0$ of the metal shutter 170 shown in FIG. 10, and a length in the lateral direction (the direction perpendicular to the sheet in FIG. 8) which is greater than the length A of the shutter 170.

In the specification, the term "metal thin plate" means a metal thin plate which has a thickness of about 0.1 to 0.5 mm and is made of a material such as SUS304.

The die holder base 130 has a double base structure consisting of a first base 131 and a second base 132. The second base 132 is connected to a shank 150 which is coupled to a press driving force. A pair of dies 102 each of which is rotatably supported at an axially support portion 121 by a support pin 105 are disposed on the first base 131 in such a manner that the dies oppose to each other. Each paired die 102 consists of a rod portion 102*a* which is lateral member, and a forming portion 102*b* which is a vertical member, and has a side shape of, for example, a substantially L-like shape. One end of each rod portion 102*a* is pressed by a press pin 108 which is urged downward by a pressure spring 109. In order to counter the urging force, each bending dies 2 is provided with a stopper arm 107 pressing the side of the die which is opposite to that pressed by the pressure pin 108.

In the vicinity of the both ends of the first base 131, the end portions of the rod portions 102*a* of the dies 102 are always urged downward by the pressure springs 109, and the lower faces of the end portions of the rod portions 102*a* are always pressed against seats 107*a* of the stopper arms 107 which are disposed at the both sides of the second base 132. An ejection pad 103 which consists of a plurality of round bars is disposed between the forming portions 102*b* of the paired dies 102. In the bending process, the ejection pad 103 cooperates with the punch 101 so that the metal thin plate 160 is always urged by a pad spring 104 having a strength of the level at which-no positional deviation of the metal thin plate is caused.

Adjusting bolts 106 pass through the rod portions 102*a* of the two dies 102, respectively, so that the front end of each adjusting bolt 106 contacts with the first base 131. According to this configuration, the distance between the dies 102 can be adjusted, and the state where the dies 102 are fixed to the first base 131 is maintained unless the first base 131 and the second base 132 approach each other.

A plurality of compression springs 133 are interposed between the first base 131 and the second base 132 and at adequate locations. During the period when the apparatus is not operated, the two bases are kept separated from each other by a predetermined distance L, by the combination of the resilience of the compression springs 133 and hanging bolts 34 which are disposed at adequate locations. The first base 131 is hung from the second base 132 by the hanging bolts 34. The number of the hanging bolts 34 is not restricted to a certain value. One or more hanging bolts are used to connect the two bases in such a manner that the distance between the bases can be changed.

The operation of the embodiment will be described.

After the metal thin plate 160 is fed to a prefixed position by a feeding apparatus which is not shown, the die holder base 130 starts to be lowered by the driving force exerted through the shank 150. When the die holder base 130 is lowered to a predetermined position, the metal thin plate 160 is pressed by the combination of the punch 101 and the ejection pad 103. The die holder base 130 is further lowered to cause the metal thin plate 160 to be bent and pushed while maintaining this bent state, into a space formed between the paired dies 102 (the state shown in FIG. 9).

At the instant of this pushing process, the dies 102 are kept to be fixed by the combination of the, stopper arms 107 attached to the second base 132 and the adjusting bolts 106 disposed in the dies 102. In other words, in this state, the positional relationships of the parts are the same as those obtained in a usual bottom push U-shape bending die in the prior art.

As shown in the enlarged partial view of FIG. 11, specifically, the relationship between the distance $W_1$ between the paired dies 102, the thickness w of the punch 101, and the maximum allowable thickness tmax of the metal thin plate 160 is expressed as $W_1$=w+2 tmax.

In FIG. 9, when the die holder base 130 is further driven by the driving means to be lowered, the upper stoppers 110 attached to the first base 131 butt the lower stoppers 111 attached to the punch holder base 140, so that the first base 131 is inhibited from being further lowered. Namely, under this state, the first bending process which resembles the conventional U-shape bending is completed.

In the second embodiment, the operation of the press driving means is further continued. When the driving force of the driving means exceeds the resilience of the compression springs 133 interposed between the first base 131 and the second base 132, the second base 132 is further lowered so that the distance L between the first base 131 and the second base 132 is reduced.

Also the stopper arms 107 are lowered by the distance corresponding to the reduction amount of the distance L. Therefore, the paired dies 102 becomes rotatable about the respective support pins 105. At this time, the pressing forces which are respectively produced by the pressure pins 108 urged by the pressure springs 109 disposed in the first base 131 and which are applied to the rod portions 102*a* of the dies 102 cause the dies 102 to be subjected to a lever force using the respective support pin 105 as a fulcrum, so that the forming portions 102*b* of the dies 102 strongly press the edge portions 161 of the bent side faces of the metal thin plate 160.

In other words, as shown in FIG. 12, the paired dies 102 are driven so as to shorten the distance $W_2$ between the dies 102. As a result, a required specific pressure is applied to the metal thin plate 160. At this time, the relationship between the maximum distance $W_2$ of the paired dies 102 obtained at the bottom dead point of the die holder base 130, the thickness w of the punch 101, and the minimum allowable thickness tmin of the metal thin plate 160 is expressed as $W_2$<w+2 tmin, so that the edge portions 161 of the bent side faces of the formed metal thin plate is subjected to the compression plastic strain.

As a result, in the shutter 170 which is shown in FIG. 10 and obtained by completing the process of bending the metal thin plate, the inner dimension w of the U-shape has the positional relationship of w<$W_2$−2 tmin. Accordingly, the bottom dead point of the die holder base 130 is set and the reduction amount due to the pressing of the distance L between the first base 131 and the second base 132 is determined, so that the above-mentioned relationship is satisfied. It is preferable to set the relationship between the dies 102 and the punch 101 during the pressing process so that they are parallel or inclined to each other so as to approach the edge portions of the punch (the bent corners).

The second embodiment applied to the production of a shutter for a 3.5-inch magnetic disk cartridge and made of a stainless steel thin plate has been described. According to the embodiment, the distance $w_1$ between the tips of the front and back plate portions 172 and 173 was obtained with an accuracy of $w_1$=3.0 mm±0.3.

In the embodiment, the ejection pad 103 which functions as the pressing means for pressing the metal thin plate 160 into a space formed between the means and the punch 101 presses the metal thin plate 160 at positions which are outside the region of the metal thin plate 160 where the rigidity in the direction of the bent section is low (cutout portions 174 in FIG. 10), for example, three positions, the substantially center portion and the both end portions of the top plate portion 171 as shown in FIG. 10. According to this configuration, when the metal thin plate 160 is bent, the force is applied in a well-balanced manner, with the result that the bending process can stably be conducted.

The invention is not restricted to the above-described embodiments. For example, the ejection pad may be configured as shown in FIG. 13.

Figure 13:
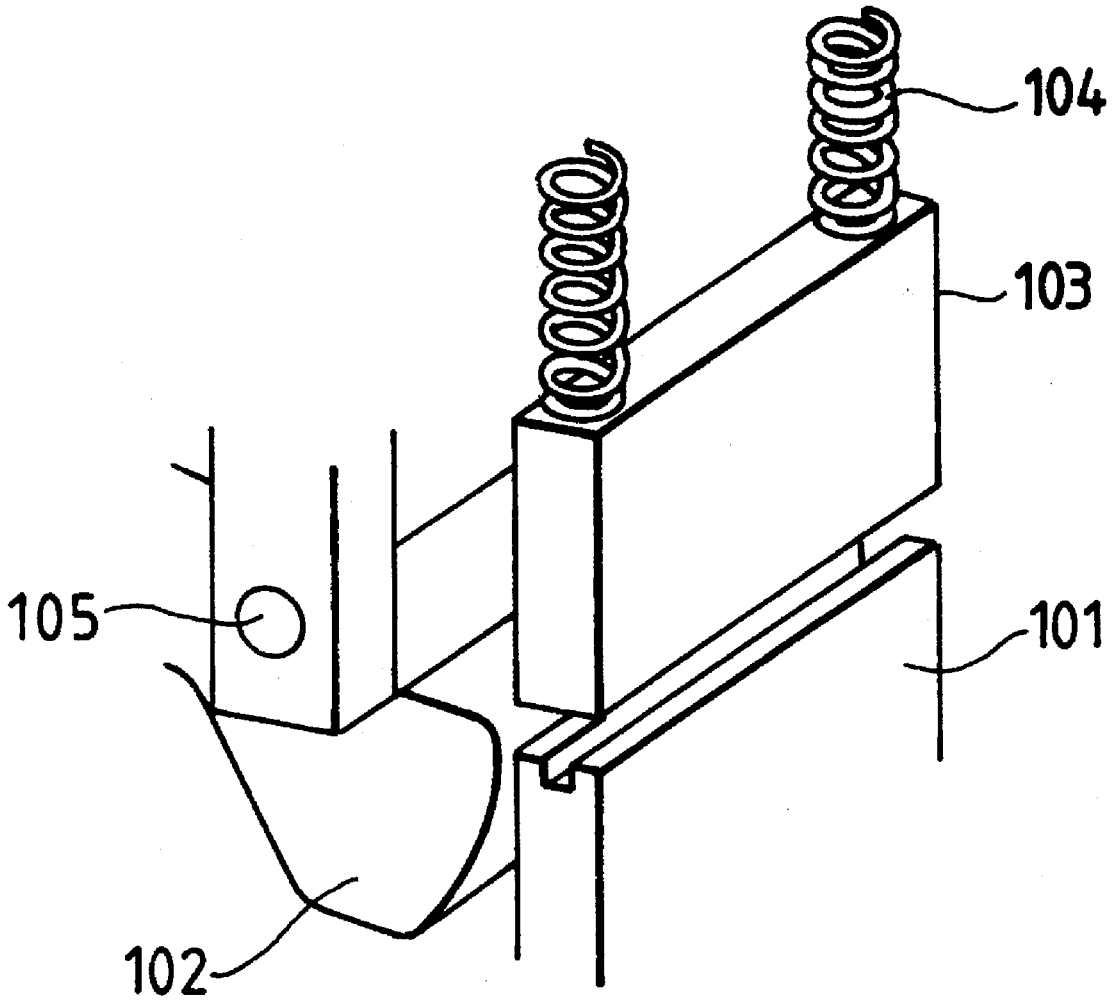
FIG. 13 is an enlarged perspective view of the main portion of another embodiment of the invention.

In the configuration shown in FIG. 13, the ejection pad 103 disposed between the paired dies 102 (only one die is shown) has a shape of a rectangular parallelpiped. The ejection pad 103 cooperates with the punch 101 so that the metal thin plate 160 is always urged by a plurality of pad springs 204 having a strength of the level at which no positional deviation is caused during the bending process.

In the embodiment, as described above, the ejection pad 103 which has a rectangular parallelpiped shape and which functions as the pressing means for pressing the metal thin plate 160 into a space formed between the means and the punch 101 is provided with at least two springs 204 and can wholly press the metal thin plate 160. Furthermore, the force exerted when the metal thin plate 160 is bent can be applied in a well-balanced manner to the region of the metal thin plate 160 where the rigidity in the bending section direction is low (cutout portions 174 in FIG. 10), by adjusting the strength of the springs 204 pressing the ejection pad 103. Consequently, the bending process can stably be conducted.

In the embodiment, the bending dies are attached to the upper base and the bending-punch is disposed on the lower base. According to the invention, the positional relationship including the bases may be inverted. Also in this modification, the entirely same functions can be attained only by changing the manner of attaching the guide posts for guiding the movement of the base. The means for pressing the dies attached to the first base is not restricted to springs, and may be other means such as pneumatic means, or hydraulic means. The shape and the like of the dies are not restricted to those shown in the figures.

As described above, in the method and the apparatus of the invention for bending a metal thin plate, the edge portions of a punch is chamfered, dies are movable in the direction of bending the metal thin plate and also in the direction of pressing the metal thin plate to the punch, and the workpiece is unloaded in the direction along which the dimensions of unload channels formed on the punch can be shortened, whereby stress generated in the punch is dispersed, and the effect of an external force is reduced. Accordingly, the life period of the punch can be improved so that the durability is largely improved, the occurrence rate of the phenomenon of the biting of a workpiece can be reduced so that the proportion defective in the unloading process is reduced, and the production cost of the punch can be reduced.

When the apparatus of the invention having movable dies is used and the method of the invention in which a large pressure is applied to the edge portions of the bent side faces of a workpiece is adopted, moreover, the movement of the movable dies can be done in accordance with the approach operation of upper and lower bases. Therefore, the process of bending a metal thin plate into a U-shape can be conducted in a single step with a high accuracy, and the bending process can be conducted in a predetermined manner without the influence of the scatter of the thickness of a metal thin plate. Furthermore, a special-driving system for operating the movable dies is not required, and the bending die has a simple structure. The apparatus has a reduced number of sliding portions, and therefore the pressing accuracy is substantially free from the influence due to the friction. Even when the apparatus is of the lubricant free type, a specific pressure required in the bending portions can be applied stably and easily in the lateral directions for a long period, only by conducting a simple vertical driving of the pressing machine, and products which are free from deforms such as the spring back and which have stabilized dimensions can be obtained.

What is claimed is:

1. A method of bending a metal thin plate, comprising the steps of:

preparing a punch in which edge portions are one of chamfered as curved faces and formed into an obtuse angle of 90° or more, said punch having an unload channel which extends from one end of said punch to a position corresponding to a tab-bent portion of the metal thin plate;

sandwiching the metal thin plate between said punch and pressing means;

bending the metal thin plate, under a state where the metal thin plate is sandwiched, toward said punch by dies which are respectively located at both sides of said pressing means, thereby forming the metal thin plate into a shape having a U-shaped section with bent corners such that the edge portions of the punch are located at the bent corners of the metal thin plate;

pressing the metal thin plate toward the punch after the metal thin plate is bent along said punch to form the angle of the edge portions; and unloading the bent metal thin plate in a direction along which the unload channel extends on said punch, the unload channel extending perpendicularly with respect to a direction of relative movement of the dies to the punch during bending of the metal thin plate.

2. The method according to claim 1, wherein the metal thin plate has a thickness in a range of about 0.1 to 0.5 mm.

3. The method according to claim 1, wherein the metal thin plate includes a cutout portion at one end and a pair of tab-bent portions in a vicinity of an opposite end thereof, and said punch includes a pair of unload channels through which said tab-bent portions pass.

4. The method according to claim 3, wherein said unloading step includes pushing the metal thin plate with a fork-shaped pusher having an elongated notch which extends longitudinally from a front end of the fork-shaped pusher, such that said punch enters the elongated notch while the pusher engages an end face of the metal thin plate.

5. The method according to claim 1, wherein the edge portions are chamfered as curved faces having a radius of curvature in a range of 0.05 to 0.10 mm, and the metal thin plate has a thickness in a range of 0.18 to 0.21 mm.

6. The method according to claim 1, wherein the edge portions comprise tapered chamfers such that the edge portions have an angle in a range of 90° to 93°.

7. A method of bending a metal thin plate in which, under a state where the metal thin plate is sandwiched between a punch and pressing means, the metal thin plate is bent toward said punch by dies which are respectively located at both sides of said pressing means, said method comprising the steps of:

(a) setting a die holder base, which is for holding the dies and has a double base structure in which two bases are stacked in a movement direction, in a state where the bases are separated from each other by an initial distance, the bases being biased apart by urging means which applies an urging force;

(b) urging a pair of the dies, which are disposed on the die holder base in a side of the punch, in a direction along which a distance between the dies is shortened, and maintaining the dies in a state where the dies are engaged against the urging force of the bases;

(c) after the metal thin plate is supplied under the state between the punch and the pressing means, moving the die holder base toward the punch and bending the metal thin plate substantially along the punch;

(d) further pressing the die holder toward the punch, so that a relative movement is produced in the direction along which the initial distance between the bases is shortened; and (e) cancelling the engagement of the dies by the relative movement to allow the dies to be pressed toward the punch, thereby forming an angle of bent edge portions of the metal thin plate.

8. The method according to claim 7, wherein the dies, each of which is rotatably supported at an axial support portion by a support pin, are disposed on one of the two bases in such a manner that the dies oppose each other.

9. The method according to claim 8, wherein each of said dies comprises a rod portion which is a lateral member, and a forming portion which is a vertical member so as to have a side profile which is substantially L-shaped.

10. The method according to claim 9, wherein the rod portion of each of said dies is pressed by a press pin which is urged downwardly by a pressure spring, and wherein each of said dies is provided with a stopper arm for pressing a side of the die which is opposite to that pressed by the press pin.

11. The method according to claim 7, further comprising a spring-biased ejection pad for biasing the metal thin plate against the punch during said bending of the metal thin plate.

* * * * *